United States Patent [19]

Gauntlett

[11] Patent Number: 4,743,135

[45] Date of Patent: May 10, 1988

[54] CATALOG AND MAGAZINE HOLDER

[76] Inventor: James E. Gauntlett, 3105 Shrewsbury Lane, Riva, Md. 21140

[21] Appl. No.: 45,554

[22] Filed: May 4, 1987

[51] Int. Cl.[4] ..... F16M 13/00

[52] U.S. Cl. ..... 402/70; 248/441.1

[58] Field of Search ..... 248/441.1, 451, 452, 248/453, 459, 174, 176, 247, 214, 221.2, 219.1; 281/33, 45, 46, 49, 50, 21 A, 25 A; 402/70, 80 R; 40/388, 390, 119

[56] References Cited

U.S. PATENT DOCUMENTS

| | | | |
|---|---|---|---|
| 959,479 | 5/1910 | Doolittle | 40/119 |
| 960,672 | 6/1910 | Murphy | 40/119 |
| 1,046,100 | 12/1912 | Miller | 248/452 |
| 1,361,739 | 12/1920 | Matheson | 248/214 |
| 1,379,612 | 5/1921 | Baver | 248/441.1 |
| 1,549,695 | 8/1925 | Uniack | 281/25 A |
| 1,558,350 | 10/1925 | Green | 281/25 A |
| 1,818,253 | 8/1931 | Hermann | 402/70 |
| 2,096,380 | 10/1937 | Reicks | 248/219.1 |
| 2,211,809 | 8/1940 | Brewer | 281/33 |
| 2,517,463 | 8/1950 | Cobb | 248/214 |
| 2,727,712 | 12/1955 | Holmboe | 248/219.1 |
| 2,778,153 | 1/1957 | Raby | 248/452 |
| 2,883,209 | 4/1959 | Erickson | 281/33 |
| 2,982,568 | 5/1961 | Wolfe | 281/33 |
| 3,043,047 | 7/1962 | Lafleur | 248/221.2 |
| 3,079,725 | 3/1963 | Lafleur | 248/441.1 |
| 3,486,632 | 12/1969 | Balch | 248/221.2 |
| 4,355,821 | 10/1982 | Crawford | 281/33 |
| 4,387,872 | 6/1983 | Hogue | 248/243 |
| 4,662,592 | 5/1987 | Garfinkle | 248/225.2 |

FOREIGN PATENT DOCUMENTS

| | | | |
|---|---|---|---|
| 945582 | 5/1949 | France | 402/70 |

*Primary Examiner*—Ramon O. Ramirez
*Assistant Examiner*—Robert A. Olson
*Attorney, Agent, or Firm*—Foley & Lardner; Schwartz, Jeffery, Schwaab, Mack, Blumenthal & Evans

[57] ABSTRACT

A holder for catalogs, magazines or the like has a base which may be selectively mounted on a variety of support means. The base which is formed by a first horizontal portion and a second angled portion is braced relative to each other and includes (1) holes in the horizontal portion for mounting to a shelf, (2) a U-shaped hook member for hooking onto a step-out bar and (3) an L-shaped member including tabs for insertion into shelf uprights. A generally vertical member on the angled portion supports informational material. The holder also includes slots and holes spaced such that two binders with U-shaped retainers can accommodate catalogs, magazines or the like with a wide variety of punched hole patterns.

17 Claims, 3 Drawing Sheets

1
3
5
7
9
11
13
15
17
19
21
23
25
29
31
32
33
35
53
55

CATALOG AND MAGAZINE HOLDER

BACKGROUND OF THE INVENTION

1. Field of the Invention

The invention relates to a holder for catalogs and other large or bulky charts, magazines and the like.

2. Related Art

There is often considerable difficulty in customers leafing through catalogs in automotive stores, paint stores, hardware stores and the like. Problems also arise in libraries and other facilities where application or information data in the form of bound and semi-bound volumes are made available to the public. These items are often chained to a counter, loosely piled on what might be termed a "music stand" support which is in turn attached to a peg board or the like.

There are obvious difficulties and disadvantages with these methods of displaying catalogs, magazines and other volumes in that they easily become detached, torn and most importantly lost. One basic problem when people are leafing through catalogs, magazines, etc., is that they have a tendency to lean on the catalog or magazine and its supporting surface. In the case of peg board supports, this is particularly disadvantageous, and actually destructive, because of the very nature of the material forming the peg board. Therefore, not only will the catalog or magazine become detached, but the entire support can become disconnected from its surroundings. The destruction of the peg board has the further obvious disadvantage of being extremely costly to replace, as well as leaving the premises very unsightly.

Another disadvantage of prior display and support means is that there is no easy way for the user to locate the catalog or magazine he wishes to examine. In other words, if there is a row of catalogs, it is very difficult for the user to locate the specific catalog he/she wishes to examine. At the same time, there is no easy means for associating promotional material such as rebate cards or advertising with the catalog.

One further disadvantage of the prior art devices is that each must be separately designed for a particular supporting surface.

Finally, present day catalog holders do not have uniform punching of holes, and there are at least eight known combinations of holes. Therefore, it has been difficult or impossible for various prior holders to accommodate various types of catalogs.

OBJECTS AND SUMMARY OF THE INVENTION

It is an object of the present invention to provide a catalog/magazine support which can be easily mounted on various types of supporting devices such as peg boards, shelves, step-out bars and the like.

Another object of the invention is to provide a sturdy catalog/magazine holder which can better support customer use.

Still a further object is to provide a catalog/magazine holder with display means for point of purchase material.

Another object is to reduce the number of catalog hole accommodating means from eight to two.

Yet another object is to provide a holder which can simultaneously accommodate varying lengths of catalogs.

Because of the nature of mounting the instant holder it is possible to utilize less space by mounting the holder between planograms.

The invention specifically includes a holder for catalogs, magazines or the like having a base which may be selectively mounted on a variety of support means. The base which is formed by a first horizontal portion and a second angled portion braced relative to each other and includes (1) holes in the horizontal portion for mounting to a shelf, (2) a U-shaped hook member for hooking onto a step out bar and (3) an L-shaped member including tabs for insertion into shelf uprights. A generally vertical member on the angled portion supports informational material. The holder also includes slots and holes spaced such that two binders with U-shaped retainers can accommodate catalogs, magazines or the like with a wide variety of punched hole patterns.

BRIEF DESCRIPTION OF THE DRAWINGS

The above and other objects of the invention will become better appreciated from the following description, taken together with the accompanying drawings wherein.

DETAILED DESCRIPTION OF THE INVENTION

Figure 1:
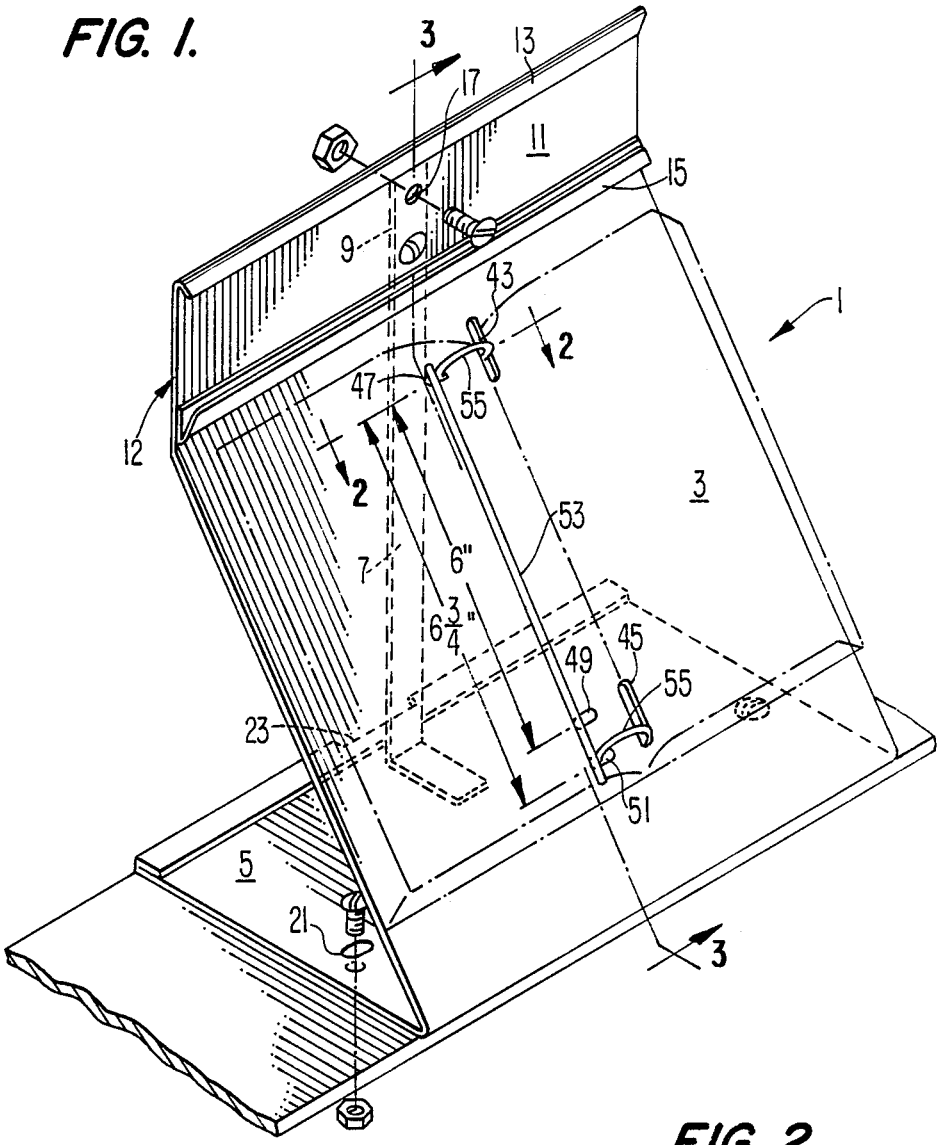
FIG. 1 is a perspective view of a catalog/magazine holder according to the instant invention.
Figure 2:
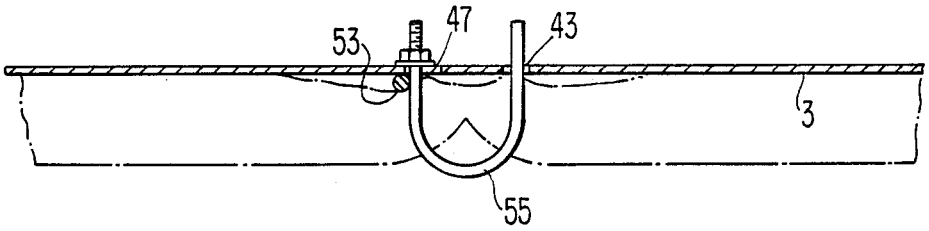
FIG. 2 is a cross-sectional view taken along lines 2—2 in FIG. 1.

Referring now to the drawings, a catalog/magazine holder 1 is seen having an angled base 3 having a horizontal portion 5. In order to support the angled base 3 relative to horizontal surface 5, a vertical upright brace 7 is attached by welding or the like to member 5. It is likewise welded at the upper end thereof at 9 on the rear surface of a vertical display portion 11. The vertical display portion 11 has an upper bent channel 13 and a lower channel 15. Channels 13 and 15 cooperate together to permit display and point of purchase material to be retained on the support. This obviously permits the point of purchase or promotional material to be readily changed without any permanent affixing means. The vertical surface 11 includes a pair of holes 17 which have cooperating holes 19 in the upright 7. The purpose of these will be discussed below. The horizontal member 5 also includes a pair of holes 21 in order to mount the support on a shelf, as again discussed below.

Seen generally at the center rear of the horizontal member 5 is a notch 23 which is used to stabilize the support relative to a vertical upright which extends slightly forward from the peg board which it in turn supports.

Figures 3, 4, 5:
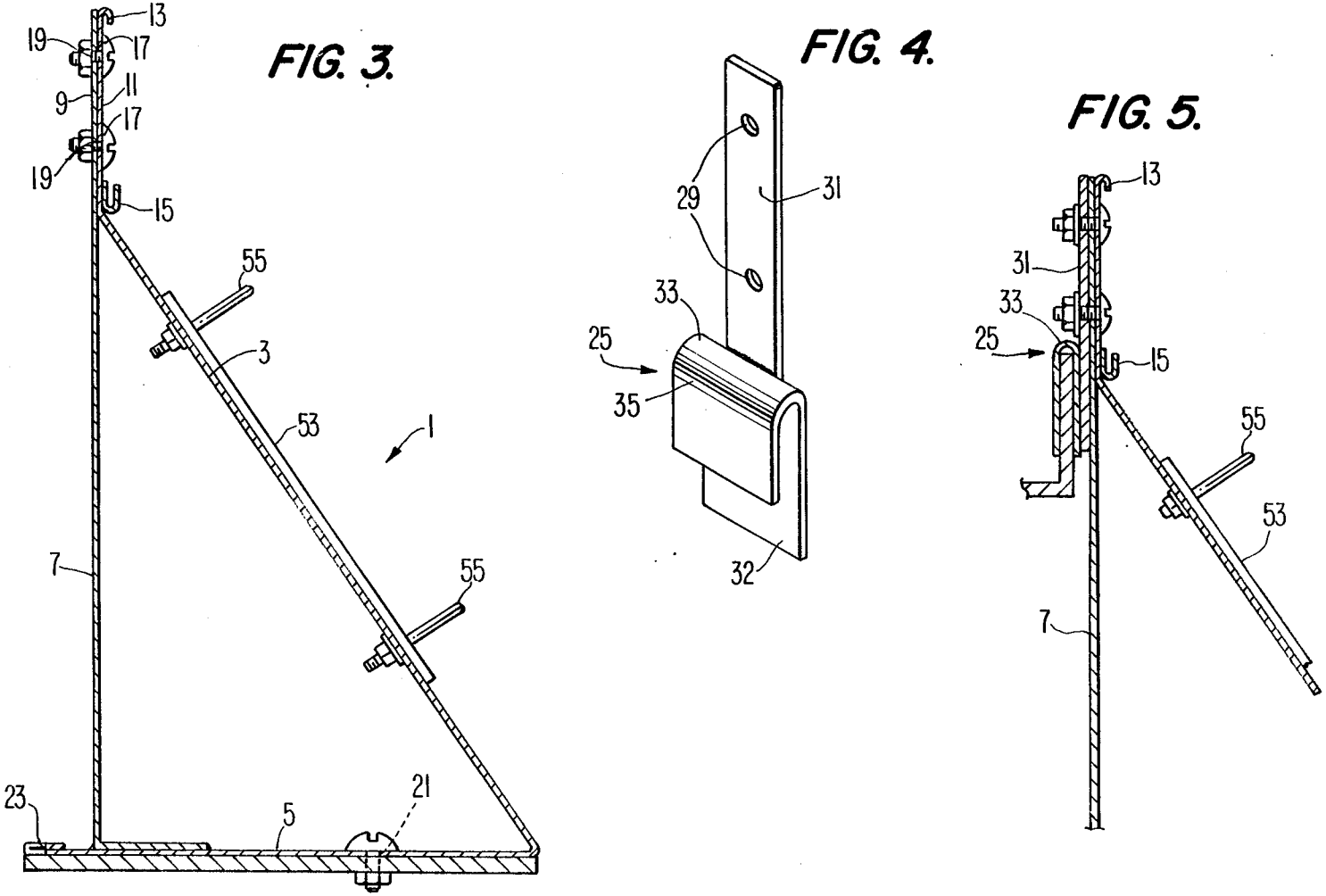
FIG. 3. is a cross-sectional view taken along lines 3—3 in FIG. 1.
FIG. 4 is a detailed perspective view of a mounting member.
FIG. 5 is a cross-sectional view, similar to FIG. 3, partially enlarged and incorporating the mounting member of FIG. 4.

When mounting the support to a shelf as in FIG. 3, conventional nuts and bolts are inserted through holes 21 and corresponding holes in the shelf to thus firmly stabilize the support on the shelf. It will be appreciated that even if someone leans on the angled surface 3, the combination of the shelf, horizontal surface 5 and vertical support 7 will retain the support in a stable position.

Alternative means of mounting the support, via the same two nuts and bolts, are found in FIGS. 4–7 in conjunction with holes 17 and 19. A pair of selectively usable mounting members 25 and 27 are utilized depending upon what other surface the support is being attached to.

Mounting member 25 seen in FIGS. 4 and 5 includes a pair of holes 29 cooperating with nuts and bolts extending through holes 17 and 19. The holes 29 are formed in a vertical member 31 which is welded to a rear surface 32 of a generally U-shaped hook member having a bight portion 33 and another U-shaped member 35. The purpose of mounting member 25 is to position the support on a step out bar whereby the U-shaped portion is slid over the step out bar until the bight portion 33 is abutted.

Figure 6:
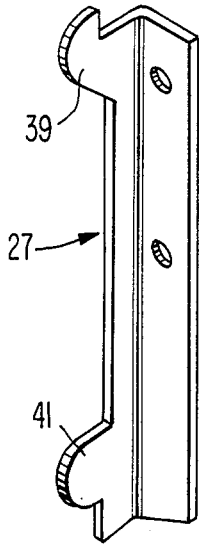
FIG. 6 is a detailed perspective view of modified mounting member.
Figure 7:
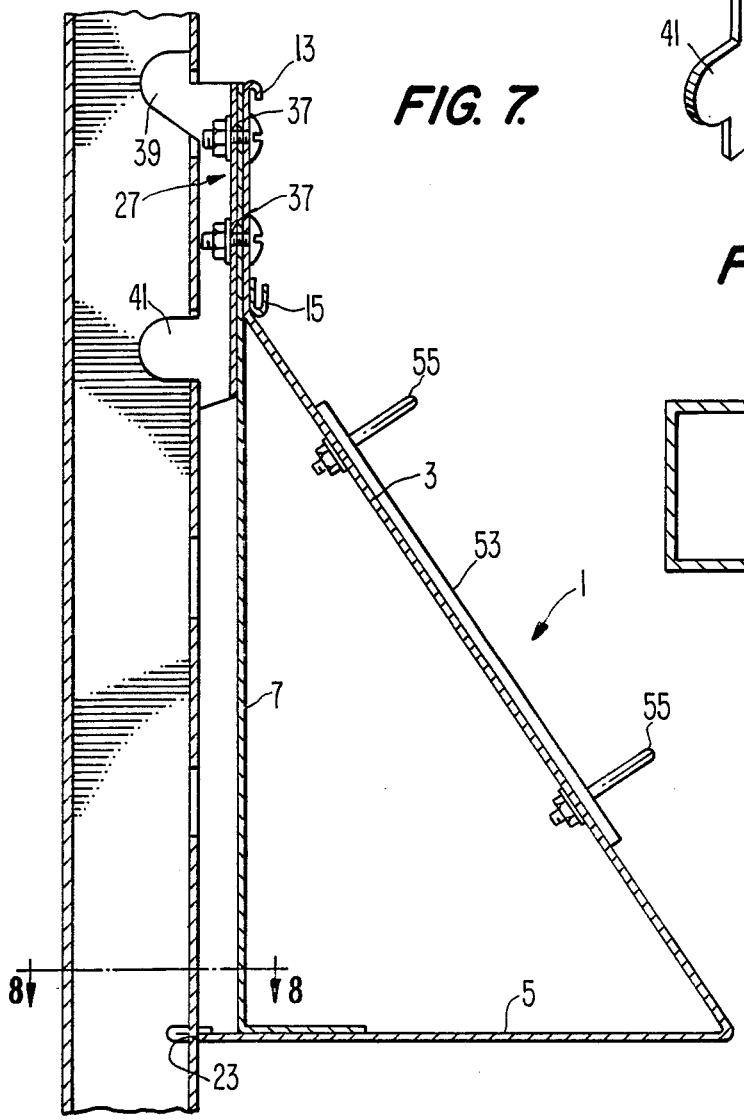
FIG. 7 is a cross-sectional view incorporating the mounting member of FIG. 6.
Figure 8:
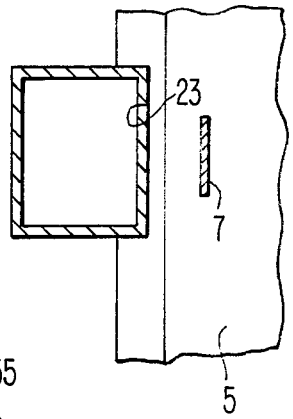
FIG. 8. is a cross-sectional view taken along lines 8—8 in FIG. 7.

Mounting member 27 in FIG. 6 also has corresponding holes 37 in an L-shaped member. The L-shaped member includes a pair of extending tabs 39 and 41 for cooperating with slots in shelf support upright members, i.e., in the slots where the shelf supports normally fit (see FIG. 7).

Notch 23 cooperates with mounting member 27 so that it will straddle the upright into which mounting member 27 is inserted.

Referring to the front face of the angled support 3, a pair of elongated slots 43 and 45 are provided slightly to the right of center. Cooperating with slot 43 is an upper hole 47; whereas, holes 49 and 51 cooperate with slot 45. Regardless of the number of holes in the catalog or magazine, one of two binders 53 can be utilized. It will be seen that the distance between holes 47 and 49 is 6", and the distance between holes 47 and 51 is 6 ¾". This combination of using holes 47 and 49 or 47 and 51, together with slots 43 and 45 will accommodate any of the commonly used hole punch systems. The binder 53 includes a pair of U-shaped retainer members 55, the ends of the "U's" being inserted in respective holes and slots in a conventional manner. The U-shaped portion attached to the cross piece 53 has threaded portions which cooperate with nuts on the rear surface of the angled portion 3 in order to retain the binders and their respective catalogs on the support.

The distance between hole 47 and the bend 12 is selected so that the top of the catalog does not strike the bend and channel 15. The distance selected is greater than 1".

In operation, the support is mounted on one of the three types of fixtures discussed above. The catalogs are then inserted by use of the binders 53 cooperating with the various slots and holes. Promotional material is readily changeable, as are the catalogs and magazines, by means of the channels 13 and 15.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A holder kit for catalogs, magazines and the like, comprising:
   (a) a base having a generally first horizontal portion and a second angled portion connected thereto;
   (b) means for retaining a catalog, magazine or the like on said angled portion;
   (c) a generally vertical member extending from at least one of said portions;
   (d) means for selectively mounting said base on shelf uprights, shelves, step-out bars and the like wherein said mounting means includes:
      (1) means including said base for mounting the holder on a shelf or the like;
      (2) a U-shaped hook member connectable to said generally vertical member for mounting the holder on a step-out bar or the like; and
      (3) a generally L-shaped member connectable to said vertical member and having a plurality of tabs thereon for mounting the holder on a shelf upright or the like.

2. The holder of claim 1 including means for bracing said first and second portions relative to each other.

3. The holder of claim 2 wherein said bracing means comprises said generally vertical upright member and is connected to said first and second portions.

4. The holder of claim 1 including a notch in said first portion for cooperation with an upright or the like.

5. The holder of claim 1 wherein said retaining means comprises a binder and a pair of U-shaped retainer members connected to said binder.

6. The holder of claim 5 including a pair of elongated slots each receiving a first leg of said U-shaped retainers; three retainer holes, one for receiving another of the legs of one of said U-shaped retainers, and two additional holes spaced from said one hole and cooperating with another leg of the other U-shaped retainer.

7. The holder of claim 6 including threading and nuts on the legs of the retainer passing through said retainer holes.

8. A holder for catalogs, magazines and the like, comprising:
   (a) a base having a generally first horizontal portion and a second angled portion connected thereto;
   (b) means for retaining a catalog, magazine or the like on said angled portion;
   (c) said retaining means comprising a binder and a pair of U-shaped retainer members connected to said binder; and
   (d) a pair of openings, each opening receiving a first leg of a U-shaped retainer; three retainer holes, one hole for receiving another of the legs of one of said U-shaped retainers, and two additional holes spaced from said one hole and selectively cooperating with another leg of the other U-shaped retainer.

9. The holder of claim 8 including means for mounting said base on a shelf including a plurality of holes formed in said base for receiving bolts therethrough.

10. The holder of claim 8 including means for mounting said base on step out bars or the like comprising a U-shaped hook member mounted on said second portion.

11. The holder of claim 8 including a generally vertical portion extending upwardly from said second portion.

12. The holder of claim 11 including a U-shaped hook member mounted on said generally vertical portion.

13. The holder of claim 12 including a vertical member, said U-shaped hook member connected to said vertical member and said vertical member being removably connected to said vertical portion.

14. The holder of claim 11 including an L-shaped member with tabs thereon removably connected to said vertical portion.

15. The holder of claim 11 including means on said vertical portion for receiving advertising or other informational material.

16. The holder of claim 15 wherein said receiving means comprises at least one channel.

17. The holder of claim 8 including means for mounting said base on a shelving upright or the like comprising an L-shaped member having a plurality of tabs thereon.

* * * * *